US012139299B2

(12) United States Patent
Schuver

(10) Patent No.: US 12,139,299 B2
(45) Date of Patent: Nov. 12, 2024

(54) RESEALABLE BEVERAGE CAN LID

(71) Applicant: SBH, INC., St. Louis, MO (US)

(72) Inventor: Steven S. Schuver, St. Louis, MO (US)

(73) Assignee: SBH, INC., St. Louis, MO (US)

( * ) Notice: Subject to any disclaimer, the term of this patent is extended or adjusted under 35 U.S.C. 154(b) by 194 days.

(21) Appl. No.: 18/099,801

(22) Filed: Jan. 20, 2023

(65) Prior Publication Data

US 2023/0159219 A1 May 25, 2023

Related U.S. Application Data

(63) Continuation-in-part of application No. 17/535,886, filed on Nov. 26, 2021, now Pat. No. 11,613,406, which is a continuation-in-part of application No. 17/122,888, filed on Dec. 15, 2020, now Pat. No. 11,498,719, and a continuation-in-part of application No. 17/026,277, filed on Sep. 20, 2020, now Pat. No. 11,440,700.

(51) Int. Cl.
*B65D 17/28* (2006.01)

(52) U.S. Cl.
CPC .. *B65D 17/4014* (2018.01); *B65D 2517/0014* (2013.01); *B65D 2517/0025* (2013.01); *B65D 2517/0032* (2013.01)

(58) Field of Classification Search
CPC ..... B65D 17/4014; B65D 17/4012; B65D 17/401; B65D 2517/0025; B65D 2517/0032; B65D 2517/0031; B65D 2517/0034; B65D 2517/0022; B65D 2517/0023; B65D 2517/0041; B21D 51/383; B21D 51/38
USPC ..... 220/254.3, 254.1, 351, 345.1, 269, 268, 220/270, 273, 272, 266, 730, 906; 413/16, 15, 14
See application file for complete search history.

(56) References Cited

U.S. PATENT DOCUMENTS

| | | | |
|---|---|---|---|
| 3,805,989 | A | 4/1974 | Walker |
| 3,967,752 | A | 7/1976 | Cudzik |
| 4,207,991 | A | 6/1980 | Amabili |
| 4,433,792 | A | 2/1984 | Mandel |
| 4,887,712 | A | 12/1989 | Wells |
| 5,351,853 | A | 10/1994 | Shock |
| 5,452,818 | A | 9/1995 | Yost |
| 9,315,305 | B2 | 4/2016 | Robinson |
| 2004/0256388 | A1 | 12/2004 | Rossetti et al. |
| 2013/0087563 | A1 | 4/2013 | Brandtner |

*Primary Examiner* — Robert J Hicks
(74) *Attorney, Agent, or Firm* — David H. Chervitz

(57) ABSTRACT

A resealable beverage can lid has a lid having a top side having a score line forming a panel, a first rivet formed in the lid and extending outwardly from the top side of the lid, a second rivet formed in the panel and extending outwardly from the top side of the lid, and a tab portion comprising a main body portion having a rear lifting portion having an indented portion, a first forward rupturing portion, a second forward rupturing portion, an opening formed in the body portion for forming a tongue having a first aperture, a second aperture, and the tab portion connected to the first rivet through the first aperture and the second rivet through the second aperture.

20 Claims, 15 Drawing Sheets

RESEALABLE BEVERAGE CAN LID

CROSS REFERENCE TO RELATED APPLICATIONS

This application is a continuation-in-part of U.S. patent application Ser. No. 17/535,886 filed on Nov. 26, 2021, which was a continuation-in-part of U.S. patent application Ser. No. 17/122,888 filed on Dec. 15, 2020, now U.S. Pat. No. 11,498,717, which was a continuation-in-part of U.S. patent application Ser. No. 17/026,277 filed on Sep. 20, 2020, now U.S. Pat. No. 11,440,700, the disclosures of which are incorporated herein by reference

BACKGROUND

This disclosure relates generally to a beverage can lid having an opening, and more particularly to a resealable beverage can lid for covering the opening.

Beverage cans for containing liquids such as carbonated beverages have become a universal and ubiquitous product. The beverage can is typically constructed of an aluminum alloy composition that may include aluminum, magnesium, manganese, silicon, and copper. The beverage can consists of a can body into which a liquid is filled and a can lid or end that is sealed to the can body. The can body may include a base or bottom that is dome shaped to resist internal pressure, a generally cylindrical section, a narrowed neck portion, and an open top edge. The can lid may include the lid portion that is about the same circumference as the narrowed neck portion of the can body, a scored line or weakened portion cut into the lid portion to form a panel or a tear panel having a hinge, a tab portion that is used to rupture the lid portion along the scored line to create an opening, and a rivet that is used to secure the tab to the lid portion. The rivet is an integral piece of the lid portion and is formed by stretching the center of the lid portion upwardly and then drawn to form the rivet. The lid is sealed to the can body by trimming the open top edge of the can body, bending the trimmed edge, and seaming the bent trimmed edge to the lid. In this manner, any liquid contained within the can body is sealed. To open the beverage can the tab is lifted to press against the tear panel to partially push the tear panel into the can body to create the opening in the lid. The panel does not fully detach from the lid due to the hinge portion formed in the lid by ends of the score line. Once opened, liquid from inside the can body may flow through the opening.

One problem associated with the use of the beverage can is that once opened it cannot be closed again. Since the liquid within the beverage can may be carbonated, after a period of time the carbonation escapes and the liquid becomes flat or stale. Once flat, the beverage can and its contents may be discarded which may be wasteful. Also, after opening the beverage can the contents may have to be consumed quickly because the contents cannot be preserved. Further, it is also possible that the contents of the beverage can may spill due to not being able to close the opening. In particular, when an individual is walking with an opened beverage can the individual may trip or fall and the contents of the can may be spilled because the can is open. This may also be problematic if the beverage can is stationary and near electrical equipment such as a computer or a laptop and the can is accidentally knocked over. It is also possible that insects, contaminants, or other unwanted matter may infiltrate the beverage can through the opening. If this occurs, then the beverage can and its contents should be thrown away, discarded, or recycled.

The present disclosure is designed to obviate and overcome many of the disadvantages and shortcomings experienced with prior beverage can constructions. Particularly, it would be advantageous to be able to have a resealable beverage can lid for preserving the contents of the beverage can. Moreover, the present disclosure is related to a resealable beverage can lid that can be easily resealed for later use, to prevent spillage, or to prevent contaminants from entering the can once opened.

SUMMARY

In one form of the present disclosure, a resealable beverage can lid is disclosed which comprises a lid having a top side having a score line forming a panel, a first rivet formed in the lid and extending outwardly from the top side of the lid, a second rivet formed in the panel and extending outwardly from the top side of the lid, and a tab portion comprising a main body portion having a rear lifting portion having an indented portion, a first forward rupturing portion, a second forward rupturing portion, an opening formed in the body portion for forming a tongue having a first aperture, a second aperture, and the tab portion connected to the first rivet through the first aperture and the second rivet through the second aperture.

In another form of the present disclosure, a resealable beverage can lid comprises a lid having a top side having a score line forming a detachable panel, a first rivet formed in the lid and extending outwardly from the top side of the lid, a second rivet formed in the detachable panel and extending outwardly from the top side of the lid, and a tab portion comprising a main body portion having a rear lifting portion having an indented portion, a first forward rupturing portion, an extension portion having a second forward rupturing portion, an opening formed in the body portion for forming a tongue having a first rivet opening, the extension portion having a second rivet opening, the first rivet opening for receiving the first rivet and the second rivet opening for receiving the second rivet with the first rivet and the second rivet for connecting the tab portion to the top side of the lid, the first forward rupturing portion for freeing the detachable panel from the lid for forming a lid opening with the indented portion for covering the lid opening.

In still another form of the present disclosure, a resealable beverage can lid comprises a lid having a top side having a score line forming a panel with the panel capable of being separated from the lid along the score line for forming a lid opening, and a bottom side, a first rivet formed in the lid and extending outwardly from the top side of the lid, a second rivet formed in the panel and extending outwardly from the top side of the lid, and a tab portion comprising a main body portion having a rear lifting portion having an indented portion, a first forward rupturing portion, a second forward rupturing portion, an opening formed in the body portion for forming a tongue having a first rivet opening, a second rivet opening, the tab portion connected to the first rivet and the second rivet, the tab portion capable of movement about the first rivet with movement of the tab portion capable of moving the indented portion into the lid opening.

In light of the foregoing comments, it will be recognized that the resealable beverage can lid of the present disclosure is of simple construction and design and which can be easily employed with highly reliable results.

The present disclosure provides a resealable beverage can lid that may be used to reseal an opened beverage can to preserve the contents of the beverage can for later use.

The present disclosure provides a resealable beverage can lid that employs an easy to use closure mechanism that allows an individual to reseal the lid of an opened beverage can.

The present disclosure provides a resealable beverage can lid that does not require any special tools to use the resealable beverage can lid.

The present disclosure also provides a resealable beverage can lid that can be used with any sized beverage can.

The present disclosure provides a resealable beverage can lid that can be constructed using readily available materials and construction techniques and machinery.

The present disclosure also provides a resealable beverage can lid having a closure mechanism that does not add significantly to the cost of manufacturing the beverage can lid.

The present disclosure is also directed to a resealable beverage can lid that can be used to open and close the lid of an opened beverage can several times.

The present disclosure is further directed to a resealable beverage can lid that allows use of a tab portion to move a tear panel into an opened position and a closed position.

The present disclosure is also directed to a resealable beverage can lid that has a tab having a first rupturing portion and a second rupturing portion that are used to fully separate a panel from the lid.

These and other advantages of the present disclosure will become apparent after considering the following detailed specification in conjunction with the accompanying drawings, wherein:

DETAILED DESCRIPTION OF A PREFERRED EMBODIMENT

Figure 1:
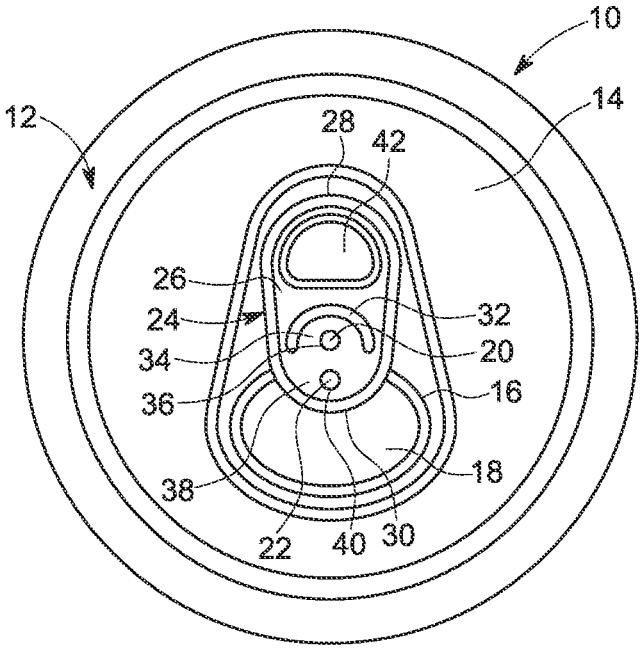
FIG. 1 is a top view of a resealable beverage can lid constructed according to the present disclosure.

Referring now to the drawings, wherein like numbers refer to like items, number 10 identifies a preferred embodiment of a resealable or reclosable beverage can lid constructed according to the present disclosure. Referring now to FIG. 1, the resealable beverage can lid 10 is shown to comprise a lid 12 having a top side 14 having a score line 16 for forming a completely separable tear panel 18. The lid 12 has a first rivet 20 formed therein with the first rivet 20 extending outwardly from the top side 14 of the lid 12. A second rivet 22 is formed within the tear panel 18 and extends outwardly from the top side 14 of the lid 12. A tab element or portion 24 is connected to the first rivet 20 and the second rivet 22. The tab portion 24 is used to open the lid 12 by rupturing the score line 16 to completely free the tear panel 18 from the lid 12. The tab portion 24 comprises a main body portion 26 having a rear lifting portion or end 28 and a forward rupturing portion or end 30. A generally U-shaped opening 32 is used to form a generally semicircular portion or tongue 34 that has a first aperture or first rivet opening 36 formed therein for receiving the first rivet 20. In this manner, the tab portion 24 is staked or held to the lid 12. The first aperture 36 also allows the tab portion 24 to rotate or move about the first rivet 20. The tab portion 24 also has a front portion 38 having a second aperture or second rivet opening 40 formed therein for receiving the second rivet 22. In this manner, the tab portion 24 is staked or held to the tear panel 18. An opening 42 may also be formed in the rear lifting portion 28 of the tab portion 24. Although hidden from view in this drawing figure, the score line 16 completely surrounds the panel 18 which allows the panel 18 to be completely freed from the lid 12 when the score line 16 is ruptured. The score line 16 is ruptured by use of the tab portion 24. Once the tear panel 18 is fully separated or detached from the lid 12, the tab portion 24 may be moved to move the tear panel 18. As can be appreciated, the lid 12 is shown in a closed or unopened condition in that score line 16 has not been ruptured to completely detach the panel 18 from the lid 12.

Figure 2:
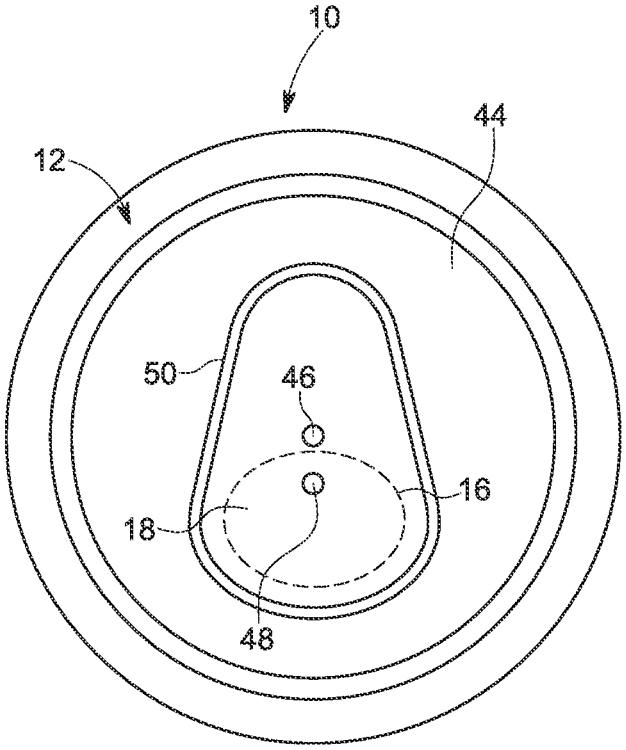
FIG. 2 is a bottom view of the resealable beverage can lid shown in FIG. 1.

FIG. 2 is a bottom view of the lid of the resealable beverage can lid 10. The lid 12 has a bottom side 44 having a first rivet indentation 46 and a second rivet indentation 48 in the bottom side 44. The indentations 46 and 48 are left over from the manufacturing process that forms the rivets 20 and 22 (FIG. 1). The score line 16 is shown in phantom in this particular view. The score line 16 completely surrounds the tear panel 18 with the tear panel 18 taking on the shape or outline of the score line 16. The bottom side 44 may also have formed therein a reinforcing rib 50 to help in strengthening the lid 12. Again, the lid 12 is shown in a closed or unopened position in that score line 16 has not been fractured or ruptured to separate the panel 18 from the lid 12.

Figure 3:
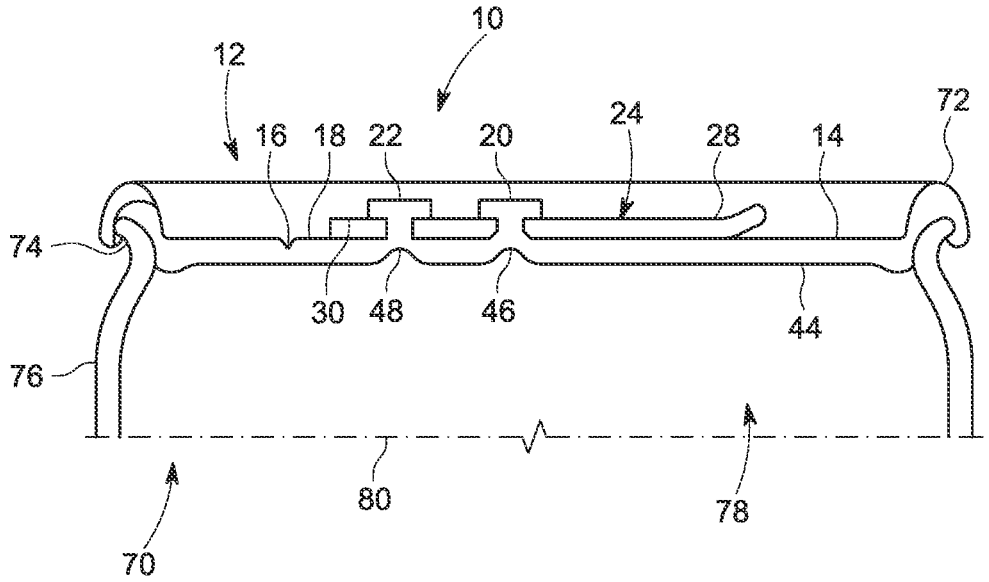
FIG. 3 is a partial cross-sectional view of a beverage can having the resealable beverage can lid constructed according to the present disclosure connected to the beverage can with the resealable beverage can lid being shown in a closed position.

With reference now to FIG. 3, a partial cross-sectional view of the resealable beverage can lid 10 being connected to a beverage can 70 is shown. The lid 12 has a flange 72 that is shaped to receive a neck portion 74 of a cylindrical can body 76. The can body 76 has an interior 78 in which a liquid 80, such as a carbonated beverage, is filled. As can be appreciated, the lid 12 is used to seal or cap the neck portion 74 of the can body 76. The lid 12 has the top side 14 having the score line 16 surrounding the panel 18. The lid 12 has the first rivet 20 that extends outwardly from the top side 14. The panel 18 also has formed therein the second rivet 22 that extends outwardly from the top side 14 of the lid 12. The lid 12 also has the bottom side 44 which has the first rivet indentation 46 and the second rivet indentation 48 formed therein. The tab portion 24 is staked to the lid 12 by the first rivet 20 and to the tear panel 18 by the second rivet 22. The rear lifting portion 28 and the forward rupturing portion 30 of the tab portion 24 are also illustrated. The panel 18 is shown in an initial closed position in which the score line 16 has not been ruptured. The liquid 80 within the beverage can 70 cannot escape because there is no opening in the lid 12.

Figure 4:
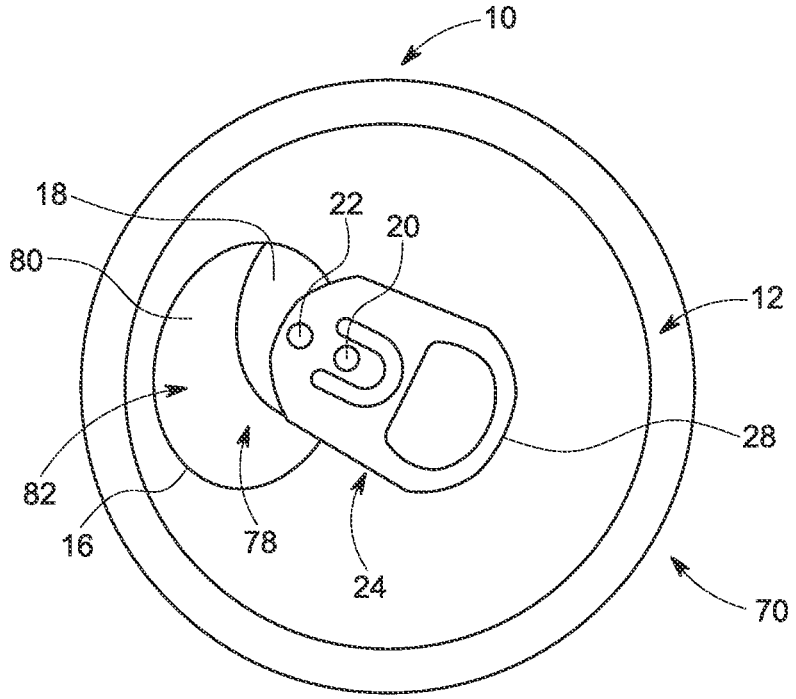
FIG. 4 is a top view of the resealable beverage can lid constructed according to the present disclosure with the panel in the process of being moved to in a partially opened position.

FIG. 4 illustrates a top view of the resealable beverage can lid 10 connected to the beverage can 70 with the tear panel 18 being separated from the lid 12 along the score line 16 and in the process of being moved into an opened position. The tab portion 24 has been slightly rotated or moved so that the tear panel 18 is no longer covering an opening 82 formed by rupturing the score line 16. The liquid 80 within the beverage can 70 is now visible and able to be removed or emptied from the can 70. The tab portion 24 may be moved to seal, block, or close the opening 82. Once the panel 18 is moved into the closed position the liquid 80 within the beverage can 70 is prevented from escaping or being spilled. To reopen the opening 82, the tab portion 24 is grasped by the rear lifting portion 28 to move the panel 18 back into the interior 78 of the beverage can 70. Once the panel 18 is re-positioned into the opened position, any contents within the beverage can 70 may be removed, used, or emptied. The second rivet 22 is used to prevent the tear panel 18 from falling into the beverage can 70. The first rivet 20 is used to keep the tab portion 24 staked to the lid 12 so that the tab portion 24 may be moved to open or close the opening 82.

Figure 5:
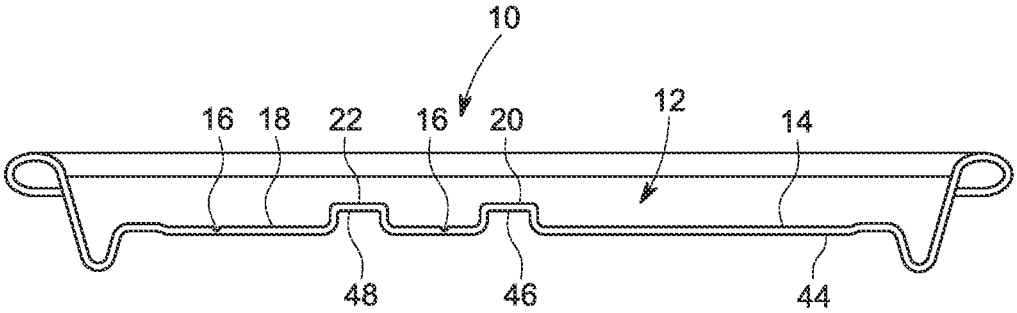
FIG. 5 is an enlarged cross-sectional view of the resealable beverage can lid constructed according to the present disclosure with the tab portion removed for clarity.

Referring to FIG. 5, an enlarged cross-sectional view of the resealable beverage can lid 10 with the tab portion 24 removed is depicted. The resealable beverage can lid 10 has the lid 12 having the top side 14 and the bottom side 44. The top side 14 has the score line 16 formed therein for outlining and forming the panel 18. The lid 12 has the first rivet 20 formed therein with the first rivet 20 extending outwardly from the top side 14 of the lid 12. The first rivet 20 has the first rivet indentation 46 formed in the bottom side 44 of the lid 12 during the manufacturing process that forms the first rivet 20. The second rivet 22 is also formed in the lid 12 and extends outwardly from the top side 14 of the lid 12. The second rivet 22 has the second rivet indentation 48 formed in the bottom side 44 of the lid 12. The second rivet indentation 48 is leftover after forming the second rivet 22.

Figure 6:
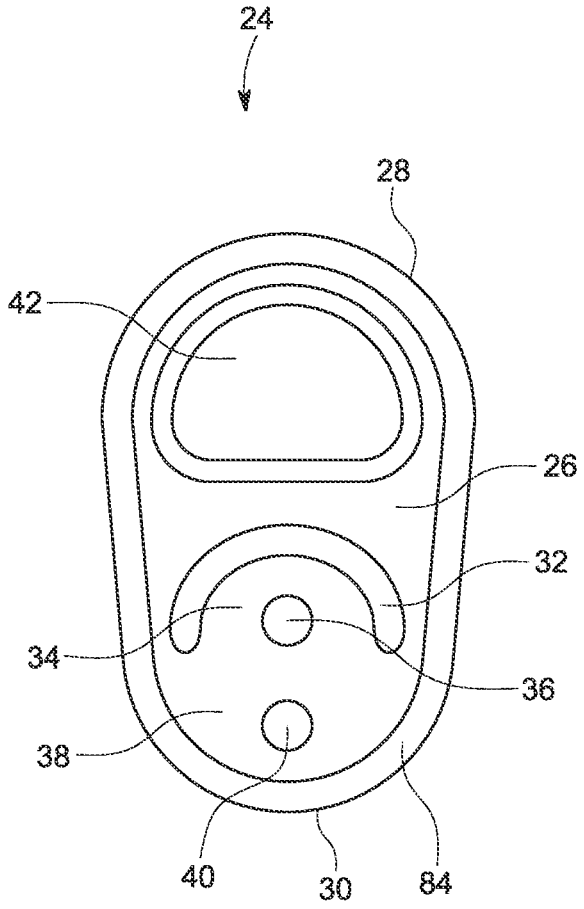
FIG. 6 is top view of a tab portion prior to being staked to a lid.

FIG. 6 shows a top view of the tab portion 24 before the tab portion 24 is connected to the first rivet 20 and the second rivet 22. The tab portion 24 comprises the main body portion 26 having the rear lifting portion or end 28 and the forward rupturing portion or end 30. The generally U-shaped opening 32 is used to form a generally semicircular portion or tongue 34 that has the first aperture 36 formed therein for receiving the first rivet 20 (not shown). The first aperture 36 also allows the tab portion 24 to rotate or move about the first rivet 20. The tab portion 24 also has the front portion 38 having the second aperture 40 formed therein for receiving the second rivet 22 (not shown). The tab portion 24 may also have a reinforced edge 84 that adds strength to the tab portion 24 so that the tab portion 24 is strong enough to separate the panel 18 from the lid 12. The opening 42 is also shown being formed in the rear lifting portion 28 of the tab portion 24.

The operation of the resealable beverage can lid 10 may be as follows. The can body 70 is filled with the liquid 80 and the lid 12 is sealed to the can body 70 and the product is then made available for purchase to an individual or consumer. Once purchased and the individual wants to use the product the individual will lift the rear lifting portion 28 of the tab portion 42 which causes the forward rupturing portion 30 to press against the panel 18 to rupture the panel 18 along the score line 16. This causes the panel 18 to completely separate from the lid 12 and to move into the interior 78 of the can body 76 to create the opening 82. However, the panel 18 is prevented from falling into the interior 78 of the can body 76 due to the panel 18 being connected to the tab portion 24 by the second rivet 22. Once the opening 82 has been created by rupturing the score line 16 the rear lifting portion 28 of the tab portion 24 is pressed downwardly which causes the tab portion 24 to return to an initial position. The opening 82 allows the individual to drink the liquid 80 from the can body 76. When the individual wants to close or reseal the opening 82 the individual may grasp the tab portion 24, such as by the rear lifting portion 28, and move or rotate the tab portion 24 to thereby move the panel 18 to cover or close the opening 82. The beverage can 70 may be held, stored, or refrigerated without concern that the liquid 80 will spill out of the beverage can 70 or that the liquid 80 will become stale or that the liquid 80 will be contaminated. When the individual desires to again drink from the beverage can 70 the individual moves the tab portion 24 to again move the panel 18 away from the opening 82 to uncover the opening 82. As is known, once the liquid 80 from the beverage can 70 has been consumed, the beverage can may be recycled.

Figure 7:
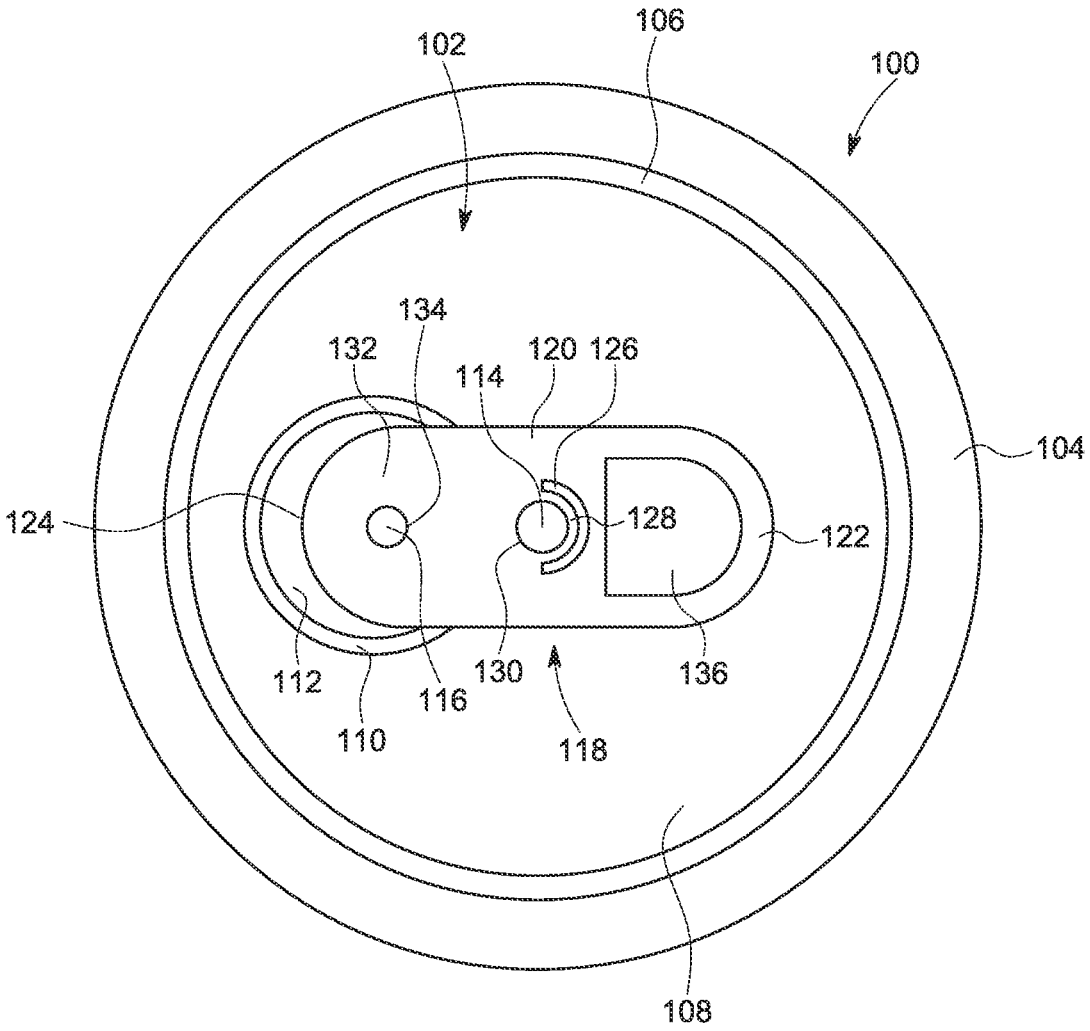
FIG. 7 is a top view of another embodiment of a resealable beverage can lid constructed according to the present disclosure connected to a beverage can.

FIG. 7 depicts another embodiment of a resealable beverage can lid 100 constructed according to the present disclosure. The resealable beverage can lid 100 is shown to comprise a lid 102 connected to a beverage can body 104 by use of a flange 106. The lid 102 has a top side 108 having a score line 110 for forming a tear panel 112. The lid 102 has a first rivet 114 formed therein with the first rivet 114 extending outwardly from the top side 108 of the lid 102. A second rivet 116 is formed within the tear panel 112 and extends outwardly from the top side 108 of the lid 102. The first rivet 114 is shown being larger than the second rivet 116. However, it is possible that the rivets 114 and 116 may be the same size or the second rivet 116 may be larger than the first rivet 114. A tab element or portion 118 is connected to the first rivet 114 and the second rivet 116. The tab portion 118 is used to open the lid 102 by rupturing the score line 110 to partially free the tear panel 112 from the lid 102. The tab portion 118 comprises a main body portion 120 having a rear lifting portion or end 122 and a forward rupturing portion or end 124. A generally U-shaped opening or slit 126 is used to form a generally semicircular portion, attachment area, or tongue 128 that has a first aperture or first rivet opening 130 formed therein for receiving the first rivet 114. In this manner, the tab portion 118 is staked or held to the lid 102. The first aperture 130 also allows the tab portion 118 to rotate or move about the first rivet 114. The tab portion 118 also has a front portion 132 having a second aperture or second rivet opening 134 formed therein for receiving the second rivet 116. In this manner, the tab portion 118 is staked or held to the tear panel 112. An opening 136 may also be formed in the rear lifting portion 122 of the tab portion 118. The score line 110 is ruptured by use of the tab portion 118. Once the tear panel 112 is ruptured or opened, the tab portion 118 may be moved to move the tear panel 112 to reseal the lid 102. As can be appreciated, the lid 102 is shown in a closed or unopened condition in that score line 110 has not been ruptured to open the lid 102.

Figure 8:
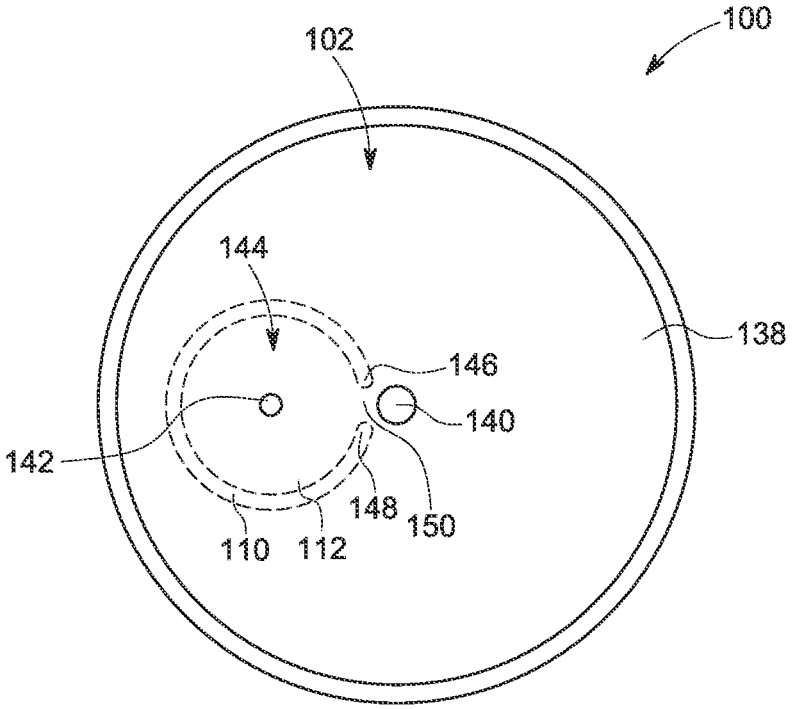
FIG. 8 is a bottom view of the resealable beverage can lid shown in FIG. 7 being removed from the beverage can.

With reference now to FIG. 8, a bottom view of the lid 102 of the resealable beverage can lid 100 is shown. In this particular view the lid 102 has not yet been connected to the beverage can body 104 (FIG. 7). The lid 102 has a bottom side 138 having a first rivet indentation 140 and a second rivet indentation 142 in the bottom side 138. The indentations 140 and 142 are left over from the manufacturing process that forms the rivets 114 and 116 (FIG. 7). The score line 110 is shown in phantom or dashed lines in this particular view. The score line 110 is used to form a perimeter or a shape 144 of the tear panel 112. The score line 110 has a first end 146 and a second end 148. A hinge 150 is formed between the first end 146 and the second end 148. The hinge 150 is adjacent to the first rivet indentation 140. The hinge 150 may be used as a spring to move the tear panel 112 by use of the tab portion 118 (FIG. 7). Also, the lid 102 is shown in a closed or unopened position in that score line 110 has not been fractured or ruptured to open the tear panel 112 from the lid 102.

Figure 9:
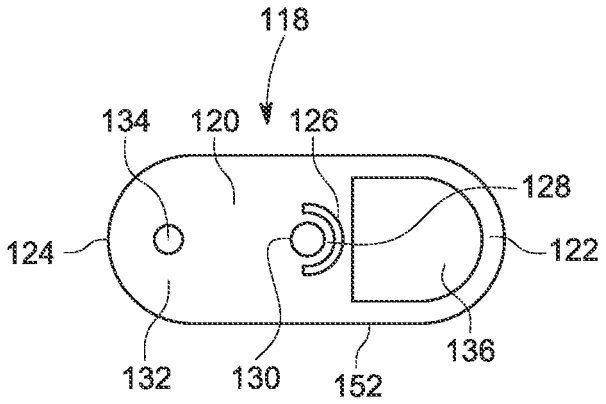
FIG. 9 is a top view of a tab portion shown in FIG. 7 prior to the tab portion being staked to the lid.

FIG. 9 illustrates the tab portion 118 before the tab portion 118 is connected to the lid 102 through use of the rivets 114 and 116. The tab portion 118 comprises the main body portion 120 having the rear lifting portion or end 122 and the forward rupturing portion or end 124. The generally U-shaped opening 126 is used to form the generally semicircular portion or tongue 128 that has the first aperture 130 formed therein for receiving the first rivet 114 (not shown). The first aperture 130 also allows the tab portion 118 to rotate or move about the first rivet 114. The tab portion 118 also has the front portion 132 having the second aperture 134 formed therein for receiving the second rivet 116 (not shown). The tab portion 118 may also have a reinforced edge 152 that adds strength to the tab portion 118 so that the tab portion 118 is strong enough to rupture the tear panel 112 from the lid 102. The opening 136 is also shown being formed in the rear lifting portion 122 of the tab portion 118.

Figure 10:
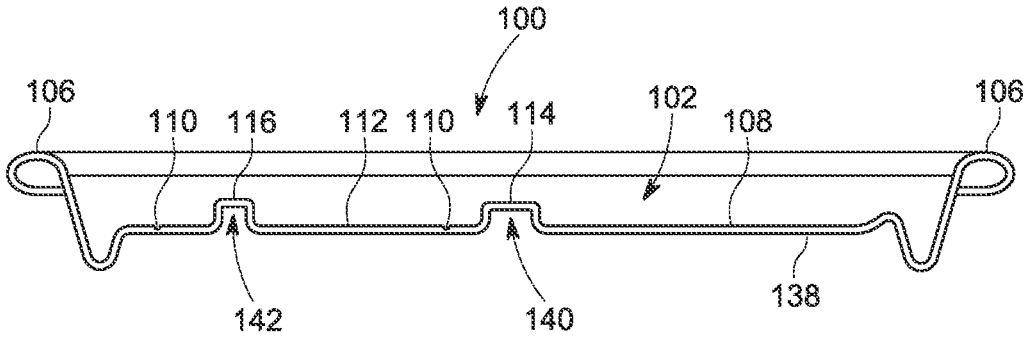
FIG. 10 is an enlarged cross-sectional view of the resealable beverage can lid shown in FIG. 7 constructed according to the present disclosure with the tab portion removed for clarity.

With particular reference now to FIG. 10, an enlarged cross-sectional view of the resealable beverage can lid 100 with the tab portion 118 removed is shown. The resealable beverage can lid 100 has the lid 102 having the top side 108 and the bottom side 138. The top side 108 has the score line 110 formed therein for outlining and forming the panel 112. The lid 102 has the first rivet 114 formed therein with the first rivet 114 extending outwardly from the top side 108 of the lid 102. The first rivet 114 has the first rivet indentation 140 formed in the bottom side 138 of the lid 102 during the manufacturing process that forms the first rivet 114. The second rivet 116 is also formed in the lid 102 and extends outwardly from the top side 108 of the lid 102. The second rivet 116 has the second rivet indentation 142 formed in the bottom side 138 of the lid 102. The second rivet indentation 142 is leftover after forming the second rivet 116. The lid 102 is also shown having the flange 106.

Figure 11:
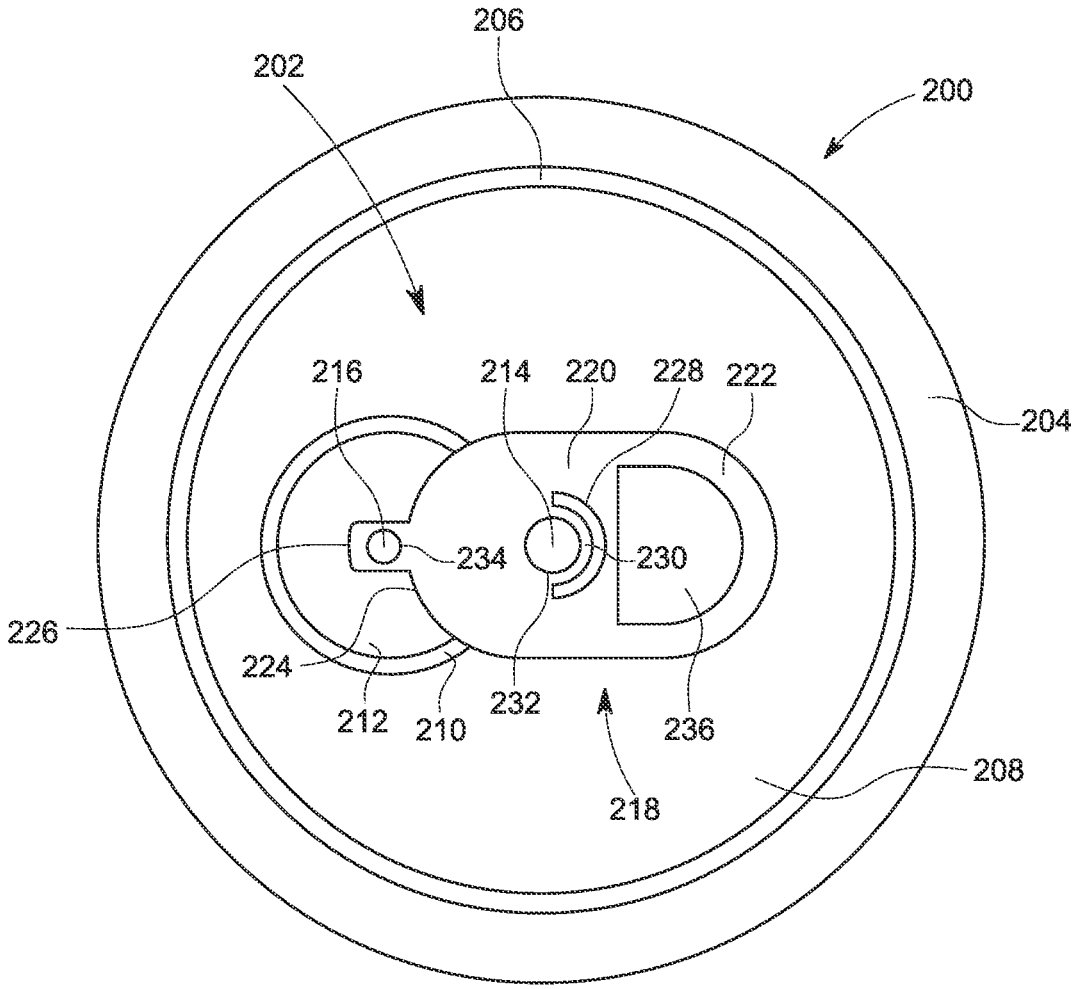
FIG. 11 is a top view of another embodiment of a resealable beverage can lid constructed according to the present disclosure connected to a beverage can.

FIG. 11 illustrates another embodiment of a resealable beverage can lid 200 constructed according to the present disclosure. The resealable beverage can lid 200 is shown to comprise a lid 202 connected to a beverage can body 204 by use of a flange 206. The lid 202 has a top side 208 having a score line 210 for forming a tear panel 212. The lid 202 has a first rivet 214 formed therein with the first rivet 214 extending outwardly from the top side 208 of the lid 202. A second rivet 216 is formed within the tear panel 212 and extends outwardly from the top side 208 of the lid 202. The first rivet 214 is shown being larger than the second rivet 216. However, it is possible that the rivets 214 and 216 may be the same size or the second rivet 216 may be larger than the first rivet 214. A tab element or portion 218 is connected to the first rivet 214 and the second rivet 216. The tab portion 218 is used to open the lid 202 by rupturing the score line 210 to partially free the tear panel 212 from the lid 202. The tab portion 218 comprises a main body portion 220 having a rear lifting portion or end 222, a forward rupturing portion or end 224, and a front extension portion 226 that extends from the forward rupturing portion 224. A generally U-shaped opening or slit 228 is used to form a generally semicircular portion, attachment area, or tongue 230 that has a first aperture or first rivet opening 232 formed therein for receiving the first rivet 214. In this manner, the tab portion 218 is staked or held to the lid 202. The first aperture 232 also allows the tab portion 218 to rotate or move about the first rivet 214. The tab portion 218 also has the front extension portion 226 having a second aperture or second rivet opening 234 formed therein for receiving the second rivet 216. In this manner, the tab portion 218 is staked or held to the tear panel 212. An opening 236 may also be formed in the rear lifting portion 222 of the tab portion 218. The score line 210 is ruptured by use of the tab portion 218. Once the tear panel 212 is ruptured or opened, the tab portion 218 may be moved to move the tear panel 212 to reseal the lid 202. As can be appreciated, the lid 202 is shown in a closed or unopened condition in that score line 210 has not been ruptured to open the lid 202.

Figure 12:
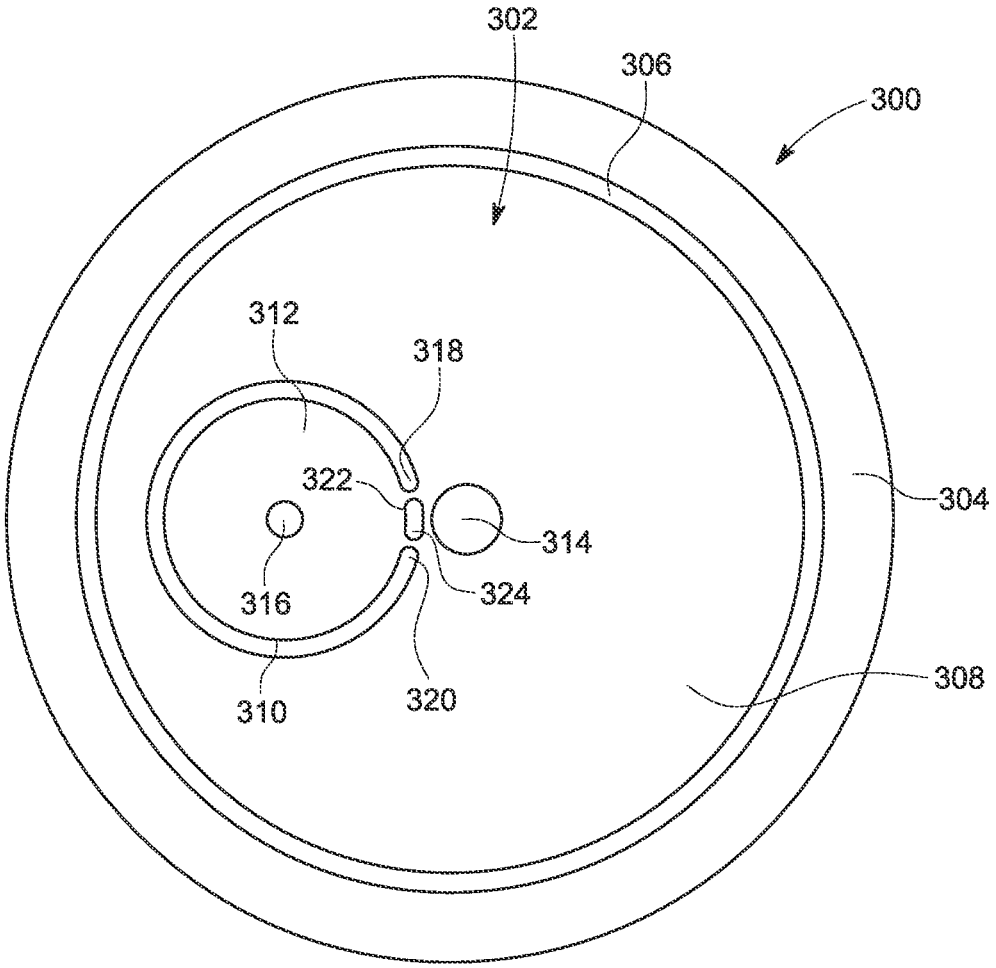
FIG. 12 is a top view of another embodiment of a resealable beverage can lid constructed according to the present disclosure connected to a beverage can with the tab portion removed for clarity.

Referring now to FIG. 12, another embodiment of a resealable beverage can lid 300 is illustrated. The resealable beverage can lid 300 is shown without a tab portion being connected for reasons of clarity. However, any of the tab portions 24, 118, or 218 may be employed with the resealable beverage can lid 300. The resealable beverage can lid 300 comprises a lid 302 connected to a beverage can body 304 by use of a flange 306. The lid 302 has a top side 308 having a first or primary score line 310 for forming a tear panel 312. The lid 302 has a first rivet 314 formed therein with the first rivet 314 extending outwardly from the top side 308 of the lid 302. A second rivet 316 is formed within the tear panel 312 and extends outwardly from the top side 308 of the lid 302. The first rivet 314 is shown being larger than the second rivet 316. However, it is possible that the rivets 314 and 316 may be the same size or the second rivet 316 may be larger than the first rivet 314. The primary score line 310 has a first end 318 and a second end 320. A hinge 322 is formed between the first end 318 and the second end 320. The hinge 322 is adjacent to the first rivet indentation 314. A second or secondary score line 324 is formed between the first end 318 and the second end 320. The secondary score line 324 may not be cut as deeply into the lid 302. The secondary score line 324 is used to completely separate the tear panel 310 from the lid 302 by use of a tab portion connected to the rivets 314 and 316.

Figure 13:
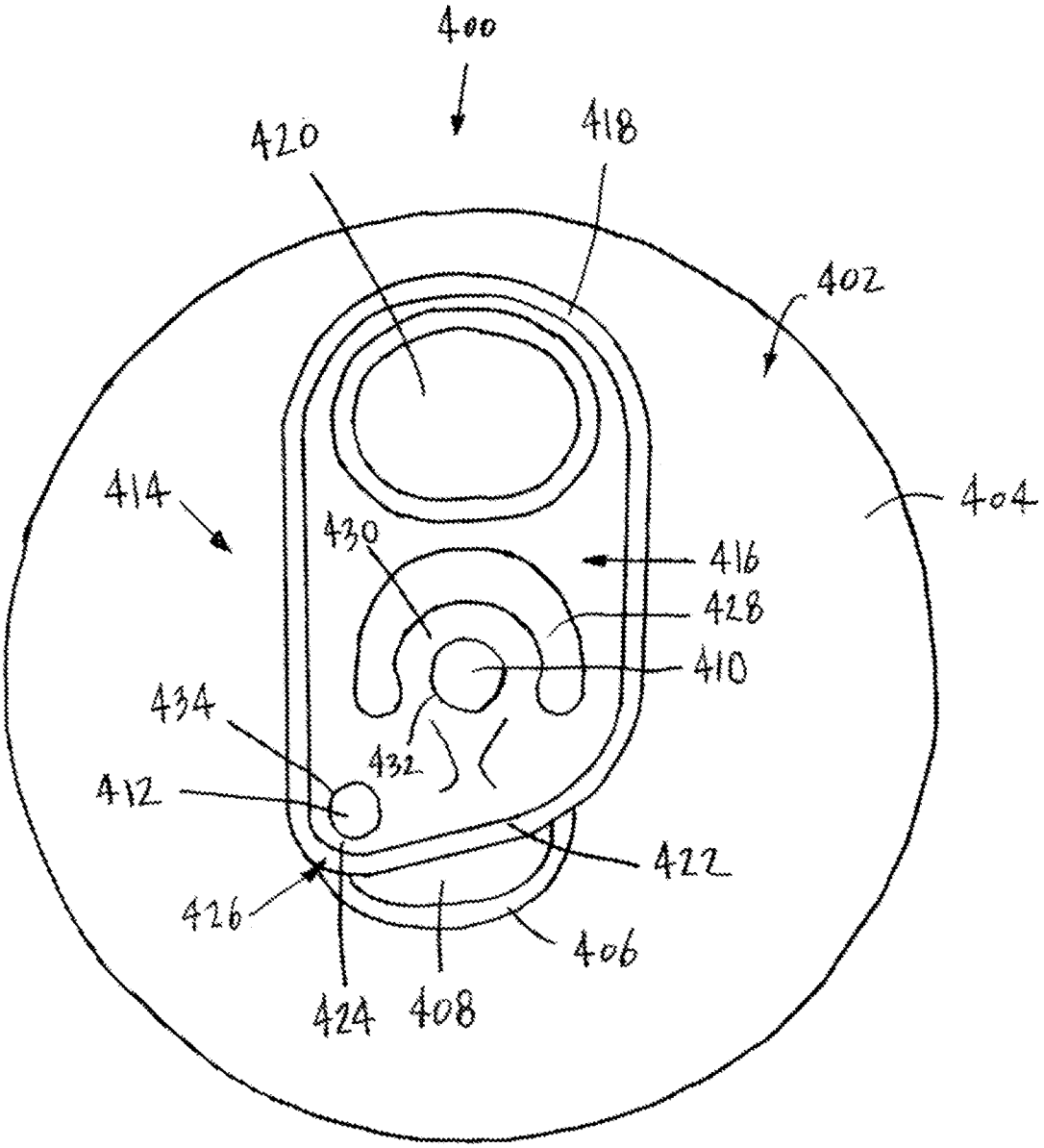
FIG. 13 is a top view of another embodiment of a resealable beverage can lid constructed according to the present disclosure.

FIG. 13 illustrates another embodiment of a resealable beverage can lid 400 constructed according to the present disclosure. The resealable beverage can lid 400 is shown to comprise a lid 402 that has a top side 404 having a score line 406 for forming a detachable or tear panel 408. The lid 402 has a first rivet 410 formed therein with the first rivet 410 extending outwardly from the top side 404 of the lid 402. A second rivet 412 is formed within the tear panel 408 and extends outwardly from the top side 404 of the lid 402. The first rivet 410 is shown being larger than the second rivet 412. However, it is possible that the rivets 410 and 412 may be the same size or the second rivet 412 may be larger than the first rivet 410. A tab element or portion 414 is connected to the first rivet 410 and the second rivet 412. The tab portion 414 is used to open the lid 402 by rupturing the score line 406 to separate, detach, or free the tear panel 408 from the lid 402 to form an opening (not shown) in the lid 402. Once the detachable panel 408 is separated from the lid 402 the tab portion 414 may be rotated about the first rivet 410. Further, the second rivet 412 ensures that the tear panel 408 does not fall into a beverage can body (not shown) that the lid 402 may be seamed or sealed to a top portion of the beverage can body. The tab portion 414 comprises a main body portion 416 having a rear lifting portion or end 418 having a solid indented portion or area 420, a first forward rupturing portion or end 422, and a front extension portion 424 having a second forward rupturing portion or end 426. A generally U-shaped opening or slit 428 is used to form a generally semicircular portion, attachment area, or tongue 430 that has a first aperture or first rivet opening 432 formed therein for receiving the first rivet 410. In this manner, the tab portion 414 is staked or held to the lid 402. As previously indicated, the first aperture 432 also allows the tab portion 414 to rotate or move about the first rivet 410. The tab portion 414 also has the front extension portion 424 having a second aperture or second rivet opening 434 formed therein for receiving the second rivet 412. In this manner, the tab portion 414 is staked or held to the tear panel 408. The score line 406 is ruptured by use of the tab portion 414 by the first rupturing portion 422 initially contacting the tear panel 408 to initially separate or detach the tear panel 408 from the lid 402. The second rupturing portion 426 contacts the tear panel 408 and is used secondarily to insure that the tear panel 408 fully separates or detaches from the lid 402 along the score line 406. Once the tear panel 408 is ruptured or opened, the tab portion 414 may be employed to move or rotate the tear panel 408 away from an opening (not shown) formed in the lid 402. If the lid 402 needs to be resealed then the rear lifting portion 418 of the tab portion 414 may be rotated so that the indented portion 420 may be inserted into an opening (not shown) formed in the lid 402. As can be appreciated, the indented portion 420 is sized and shaped so that the indented portion 420 may fit into an opening formed after the tear panel 408 is fully detached from the lid 402.

Figure 14:
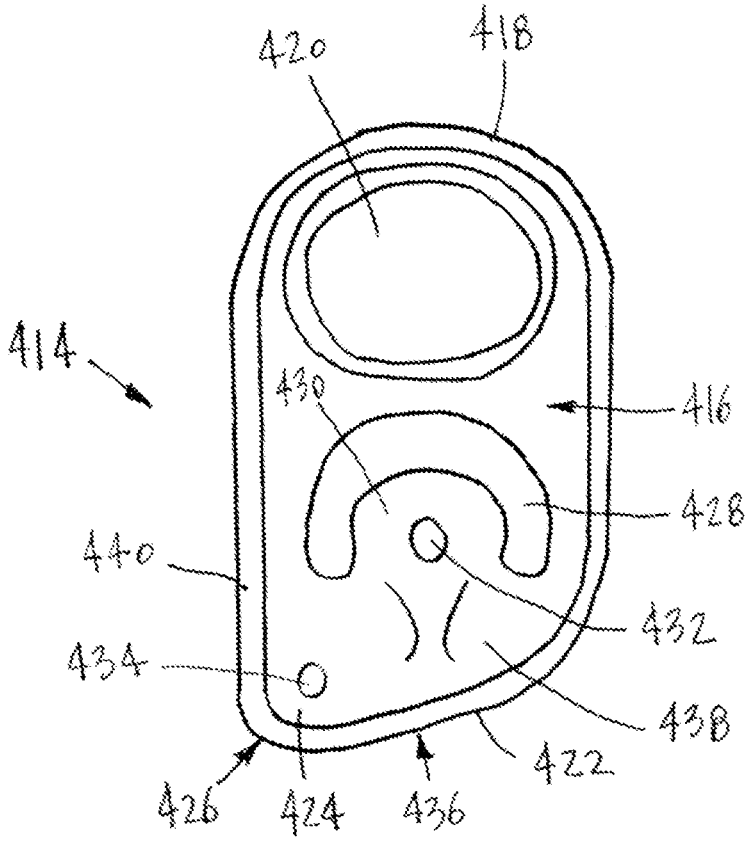
FIG. 14 is a top view of a tab portion shown in FIG. 13 prior to the tab portion being staked to the lid.

With particular reference now to FIG. 14, the tab portion 414 of FIG. 13 is shown before the tab portion 414 is connected to the lid 402 through use of the rivets 410 and 412. The tab portion 414 comprises the main body portion 416 having the rear lifting portion or end 418 having the solid indented portion 420, the first forward rupturing portion or end 422, and the front extension portion 424 having the second forward rupturing portion or end 426. The generally U-shaped opening 428 is used to form the generally semicircular portion or tongue 430 that has the first aperture 432 formed therein for receiving the first rivet 410 (not shown). The first aperture 432 also allows the tab portion 414 to rotate or move about the first rivet 410. The tab portion 414 also has the front extension portion 424 having the second aperture 434 formed therein for receiving the second rivet 412 (not shown). The first forward rupturing portion 422 has an edge 436 that is angled or slanted relative to the second forward rupturing portion 426. The tab portion 414 also has a front area or portion 438 between the first forward rupturing portion 422 and the first aperture 432. The front extension portion 424 is between the second forward rupturing portion 426 and the front portion 438. The tab portion 414 may also have a reinforced edge 440 that adds strength to the tab portion 414 so that the tab portion 414 is strong enough to rupture the tear panel 408 from the lid 402.

Figure 15:
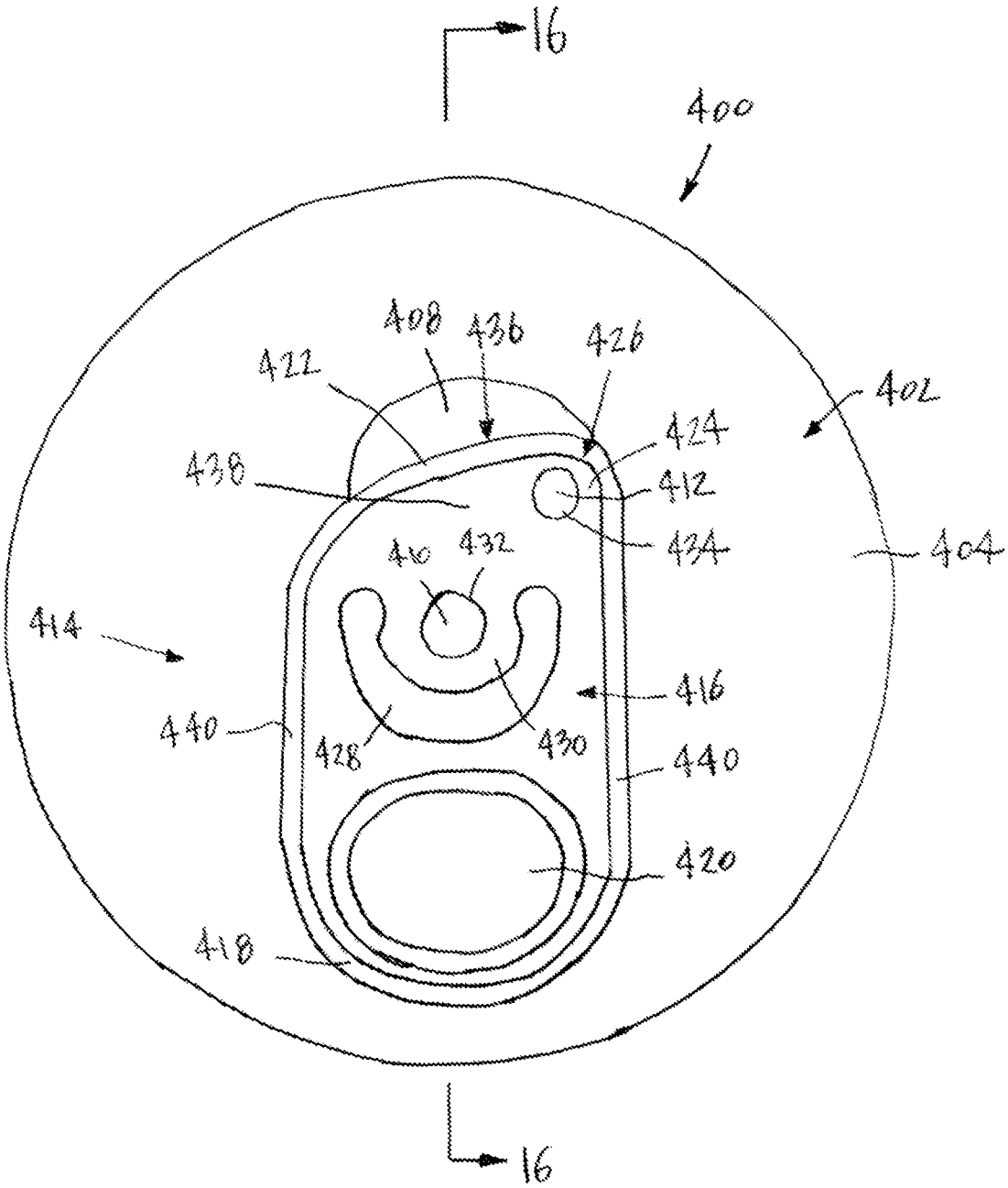
FIG. 15 is a top view of the resealable beverage can lid shown in FIG. 13 being shown in a closed or resealable position.

FIG. 15 depicts a top view of the resealable beverage can lid 400 in a resealed position. In particular, the tab portion 414 has been used to detach the tear panel 408 from the lid 402, the tab portion 414 has been rotated about the first rivet 410, and the indented portion 420 has been inserted into an opening (not shown) created by the detachment of the tear panel 408. In this manner, the lid 402 is resealed. The indented portion 420 is sized and shaped to fit into the opening (not shown) to reseal the lid 402. As should be appreciated, the indented portion 420 may be removed from the opening by use of the rear lifting portion 418 and the tab portion 414 may be rotated about the first rivet 410 to gain access to the opening. In this manner, the lid 400 may be opened or resealed as the case may be. The resealable beverage can lid 400 also has the top side 404. The tab portion 414 is also shown comprising the main body portion 416 having the rear lifting portion or end 418 having the solid indented portion or area 420, the first forward rupturing portion or end 422, and the front extension portion 424 having the second forward rupturing portion or end 426. The opening 428 is used to form the generally semicircular portion, attachment area, or tongue 430 that has the first aperture or first rivet opening 432 formed therein for receiving the first rivet 410. The tab portion 414 also has the front extension portion 424 having the second aperture or second rivet opening 434 formed therein for receiving the second rivet 412. The first forward rupturing portion 422 has the edge 436 that is angled or slanted relative to the second forward rupturing portion 426. The tab portion 414 also has the front area or portion 438 between the first forward rupturing portion 422 and the first aperture 432. The front extension portion 424 is between the second forward rupturing portion 426 and the front portion 438. The tab portion 414 also has the reinforced edge 440 that adds strength to the tab portion 414 so that the tab portion 414 is strong enough to rupture the tear panel 408 from the lid 402.

Figure 16:
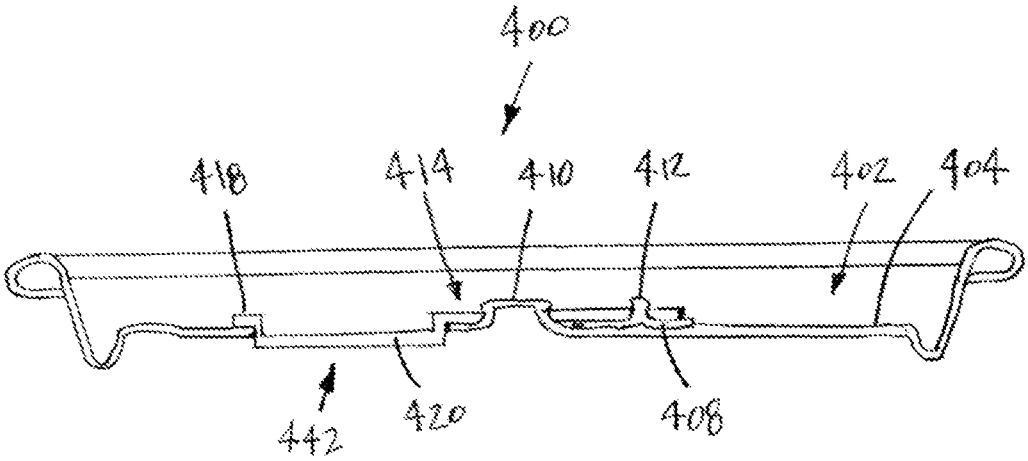
FIG. 16 is a cross-sectional view of the resealable beverage can lid taken along the plane of lines 16-16 of FIG. 15 constructed according to the present disclosure with the resealable beverage can lid being shown in a closed or resealable position.

Referring now to FIG. 16, a cross-sectional view of the resealable beverage can lid 400 being shown in the resealed position is illustrated. The resealable beverage can lid 400 comprises the lid 402 having the top side 404 having an opening 442 formed by detaching the tear panel 408 from the lid 402. The lid 402 has the first rivet 410 formed therein with the first rivet 410 extending outwardly from the top side 404 of the lid 402. The second rivet 412 is formed within the tear panel 408 and extends outwardly from the top side 404 of the lid 402. The first rivet 410 is shown being larger than the second rivet 412. The tab portion 414 is connected to the first rivet 410 and the second rivet 412. Once the detachable panel 408 is separated from the lid 402 the tab portion 414 may be rotated about the first rivet 410 away from the opening 442. Further, the second rivet 412 ensures that the tear panel 408 is connected to the tab portion 414. The rear lifting portion 418 may be used to extract the indented portion 420 from the opening 442 when access to the opening 442 is needed. As can be appreciated, the rear lifting portion 418 may be grasped to rotate the tab portion 414. The indented portion 420 allows the lid 400 to be resealed as needed.

Figure 17:
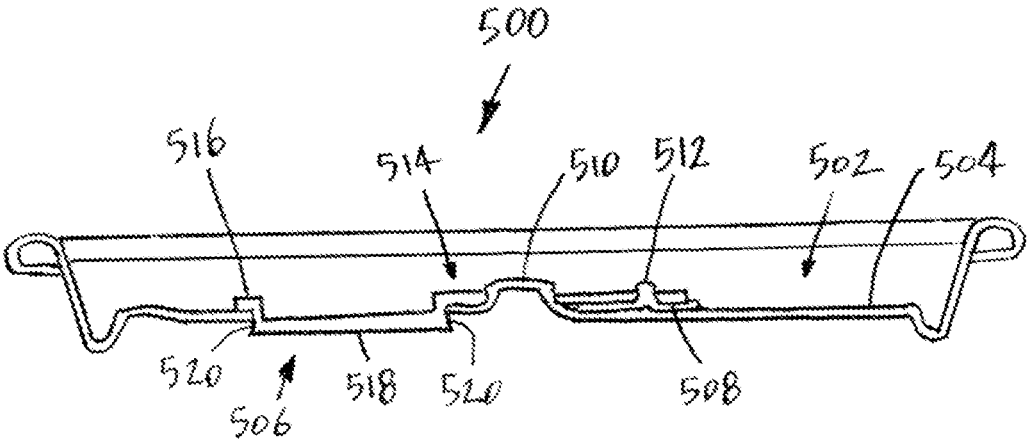
FIG. 17 is a cross-sectional view of another embodiment of a resealable beverage can lid constructed according to the present disclosure.

FIG. 17 shows a cross-sectional view of another embodiment of a resealable beverage can lid 500 being shown in the resealed position. The resealable beverage can lid 500 comprises a lid 502 having a top side 504 having an opening 506 formed by detaching a tear panel 508 from the lid 502. The lid 502 has a first rivet 510 formed therein with the first rivet 510 extending outwardly from the top side 504 of the lid 502. A second rivet 512 is formed within the tear panel 508 and the second rivet 512 is used to stake or connect a tab portion 514 to the tear panel 508. The first rivet 510 is shown being larger than the second rivet 512. Once the detachable panel 508 is separated from the lid 502 the tab portion 514 may be rotated about the first rivet 510 away from the opening 506. The tab portion 514 has a rear lifting portion 516 having a solid indented portion 518. The indented portion 518 has a slanted or angled lower portion or perimeter 520. The lower portion 520 is used to secure the indented portion 518 within the opening 506. The lower perimeter 520 of the indented portion 518 is slightly larger than the opening 506 in order to secure the indented portion 518 in place. The lower portion 520 provides a frictional engagement of the lower portion 520 within the opening 506. The tab portion 514 is similar to the tab portion 414 shown in FIG. 13 with a difference being that the tab portion 514 has the angled lower portion 520. The rear lifting portion 516 may be used to remove the indented portion 518 from the opening 506 when access to the opening 506 is needed. The indented portion 518 allows the lid 500 to be resealed or opened as needed.

Figure 18:
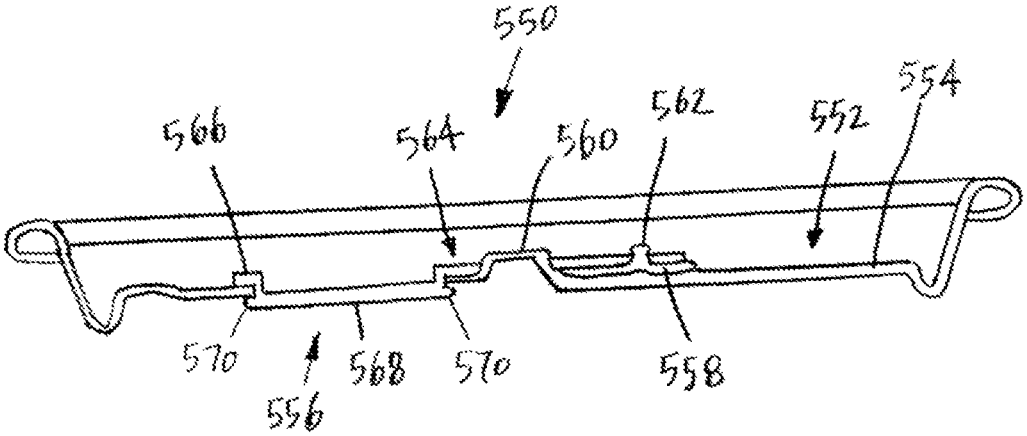
FIG. 18 is a cross-sectional view of another embodiment of a resealable beverage can lid constructed according to the present disclosure.

With reference now to FIG. 18, a cross-sectional view of another embodiment of a resealable beverage can lid 550 is illustrated in the resealed position. The resealable beverage can lid 550 comprises a lid 552 having a top side 554 having an opening 556 formed by detaching a tear panel 558 from the lid 552. The lid 552 has a first rivet 560 formed therein with the first rivet 560 extending outwardly from the top side 554 of the lid 552. A second rivet 562 is formed within the tear panel 558 and the second rivet 562 is used to stake or connect a tab portion 564 to the tear panel 558. The first rivet 560 is shown being larger than the second rivet 562. Once the detachable panel 558 is separated from the lid 552 the tab portion 564 may be rotated about the first rivet 560 away from the opening 556. The tab portion 564 has a rear lifting portion 566 having a solid indented portion 568. The indented portion 568 has a rounded or beaded lower portion or perimeter 570. The lower portion 570 is used to secure the indented portion 568 within the opening 556. The lower perimeter 570 of the indented portion 568 is slightly larger than the opening 556 in order to secure the indented portion 568 in place. In essence, the beaded lower portion 570 snaps into the opening 556. The tab portion 564 is similar to the tab portion 414 shown in FIG. 13 with a difference being that the tab portion 564 has the beaded lower portion 570. The rear lifting portion 566 may be used to remove the indented portion 568 from the opening 556 when access to the opening 556 is needed. The indented portion 568 allows the lid 550 to be resealed or opened as needed.

Preferably, the resealable beverage can lids 10, 100, 200, 300, 400, 500, and 550 will be constructed of a relatively lightweight material so that it can be easily used and manufactured. By way of example only, the resealable beverage can lids 10, 100, 200, 300, 400, 500, and 550 may be constructed of aluminum or an aluminum alloy.

Although it has been indicated herein that the resealable beverage can lids 10, 100, 200, 300, 400, 500, and 550 are used with cans that contain a liquid, such as a carbonated beverage, it is also possible and contemplated that the cans may contain other items such as non-carbonated beverages, powders, spices, foods, syrups, gums, candies, or any other item that can be removed from an opening in the lids 10, 100, 200, 300, 400, 500, and 550 and may need to be resealed or reclosed.

From all that has been said, it will be clear that there has thus been shown and described herein a resealable beverage can lid which fulfills the various objects and advantages sought therefor. It will be apparent to those skilled in the art, however, that many changes, modifications, variations, and other uses and applications of the subject resealable beverage can lid are possible and contemplated. All changes, modifications, variations, and other uses and applications which do not depart from the spirit and scope of the disclosure are deemed to be covered by the disclosure, which is limited only by the claims which follow.

What is claimed is:

1. A resealable beverage can lid comprising:

a lid having a top side having a score line forming a panel;

a first rivet formed in the lid and extending outwardly from the top side of the lid;

a second rivet formed in the panel and extending outwardly from the top side of the lid; and a tab portion comprising a main body portion having a rear lifting portion having an indented portion, a first forward rupturing portion, a second forward rupturing portion, an opening formed in the body portion for forming a tongue having a first aperture, a second aperture, and the tab portion connected to the first rivet through the first aperture and the second rivet through the second aperture.

2. The resealable beverage can lid of claim 1 wherein the indented portion comprises an angled lower portion.

3. The resealable beverage can lid of claim 1 wherein the indented portion comprises a beaded lower portion.

4. The resealable beverage can lid of claim 1 wherein the panel is capable of being freed from the lid to form an opening in the lid with the indented portion capable of being positioned into the opening.

5. The resealable beverage can lid of claim 1 wherein the panel is capable of being freed from the lid along the score line.

6. The resealable beverage can lid of claim 1 wherein the first forward rupturing portion and the second forward rupturing portion are adapted for contacting the panel.

7. The resealable beverage can lid of claim 1 wherein the panel is capable of being freed from the lid to form an opening in the lid and the first forward rupturing portion is adapted to initially contact the panel and the second forward rupturing portion is adapted to secondarily contact the panel.

8. A resealable beverage can lid comprising:

a lid having a top side having a score line forming a detachable panel;

a first rivet formed in the lid and extending outwardly from the top side of the lid;

a second rivet formed in the detachable panel and extending outwardly from the top side of the lid; and a tab portion comprising a main body portion having a rear lifting portion having an indented portion, a first forward rupturing portion, an extension portion having a second forward rupturing portion, an opening formed in the body portion for forming a tongue having a first rivet opening, the extension portion having a second rivet opening, the first rivet opening for receiving the first rivet and the second rivet opening for receiving the second rivet with the first rivet and the second rivet for connecting the tab portion to the top side of the lid, the first forward rupturing portion for freeing the detachable panel from the lid for forming a lid opening with the indented portion for covering the lid opening.

9. The resealable beverage can lid of claim 8 wherein the indented portion comprises an angled lower portion.

10. The resealable beverage can lid of claim 8 wherein the indented portion comprises a beaded lower portion.

11. The resealable beverage can lid of claim 8 wherein once the detachable panel is detached from the lid an opening is formed in the lid with the indented portion capable of being positioned into the opening.

12. The resealable beverage can lid of claim 8 wherein the first forward rupturing portion and the second forward rupturing portion are adapted for contacting the detachable panel.

13. The resealable beverage can lid of claim 8 wherein the detachable panel is capable of being detached from the lid along the score line and the first forward rupturing portion is adapted to initially contact the detachable panel and the second forward rupturing portion is adapted to secondarily contact the detachable panel.

14. The resealable beverage can lid of claim 8 wherein the detachable panel is capable of being detached from the lid along the score line.

15. The resealable beverage can lid of claim 8 wherein the first forward rupturing portion and the second forward rupturing portion are adapted for contacting the panel.

16. A resealable beverage can lid comprising:

a lid having a top side having a score line forming a panel with the panel capable of being separated from the lid along the score line for forming a lid opening;

a first rivet formed in the lid and extending outwardly from the top side of the lid;

a second rivet formed in the panel and extending outwardly from the top side of the lid; and a tab portion comprising a main body portion having a rear lifting portion having an indented portion, a first forward rupturing portion, a second forward rupturing portion, an opening formed in the body portion for forming a tongue having a first rivet opening, a second rivet opening, the tab portion connected to the first rivet and the second rivet, the tab portion capable of movement about the first rivet with movement of the tab portion capable of moving the indented portion into the lid opening.

17. The resealable beverage can lid of claim 16 wherein the indented portion is sized and shaped the same as the lid opening.

18. The resealable beverage can lid of claim 16 wherein the indented portion comprises an angled lower portion.

19. The resealable beverage can lid of claim 16 wherein the first forward rupturing portion and the second forward rupturing portion are adapted for contacting the panel.

20. The resealable beverage can lid of claim 16 wherein the indented portion comprises a beaded lower portion.

* * * * *